US009463548B2

(12) United States Patent
Versluys et al.

(10) Patent No.: US 9,463,548 B2
(45) Date of Patent: Oct. 11, 2016

(54) METHOD AND SYSTEM FOR FINISHING COMPONENT USING ABRASIVE MEDIA

(71) Applicant: Hamilton Sundstrand Corporation, Charlotte, NC (US)

(72) Inventors: Kiley James Versluys, Hartford, CT (US); Sergey Mironets, Charlotte, NC (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 0 days.

(21) Appl. No.: 14/639,292

(22) Filed: Mar. 5, 2015

(65) Prior Publication Data

US 2016/0256975 A1 Sep. 8, 2016

(51) Int. Cl.

*B24B 31/06* (2006.01)
*B24B 1/04* (2006.01)
*B24B 31/00* (2006.01)

(52) U.S. Cl.

CPC ..... *B24B 31/06* (2013.01); *B24B 1/04* (2013.01); *B24B 31/003* (2013.01); *B24B 31/064* (2013.01)

(58) Field of Classification Search

CPC ..... B24B 1/04; B24B 31/00; B24B 31/003; B24B 31/06; B24B 31/064
USPC ..... 451/32, 35, 104, 113, 326, 328
See application file for complete search history.

(56) References Cited

U.S. PATENT DOCUMENTS 2,460,918 A * 2/1949 Bodine, Jr. ..... B24B 31/00 29/90.01
3,729,871 A * 5/1973 Taylor ..... B24C 1/08 451/104
4,096,666 A * 6/1978 Brown ..... B24B 31/02 241/170
4,663,005 A 5/1987 Edson
4,823,513 A * 4/1989 Marcus ..... B24B 31/064 134/1
5,295,330 A * 3/1994 Hoffman ..... B24B 31/108 384/100
5,449,313 A * 9/1995 Kordonsky ..... B24B 1/005 451/104
5,593,339 A * 1/1997 Yam ..... B08B 3/06 451/104
5,692,423 A 12/1997 Hachikawa et al.
5,863,883 A * 1/1999 Yam ..... B08B 3/06 451/104
5,873,770 A * 2/1999 Hashimoto ..... B24B 31/06 451/113
6,227,942 B1 * 5/2001 Hoffman ..... B24B 1/005 451/104
6,261,154 B1 * 7/2001 McEneny ..... B24B 29/02 451/32
6,273,787 B1 * 8/2001 Gilmore ..... B24B 31/116 451/104
6,835,300 B2 12/2004 Zhu et al.
7,261,616 B2 * 8/2007 Kordonsky ..... B24B 1/005 451/104
7,753,760 B2 * 7/2010 Petrosky ..... B24B 3/24 451/104

(Continued)

FOREIGN PATENT DOCUMENTS

EP 2403686 B1 1/2014

*Primary Examiner* — Eileen Morgan
(74) *Attorney, Agent, or Firm* — Carlson, Gaskey & Olds, P.C.

(57) ABSTRACT

A method according to an exemplary aspect of the present disclosure, includes, among other things, at least partially filling a vessel with an abrasive fluid, pressurizing the abrasive fluid, and vibrating a component within the vessel. Further, the method includes gradually adjusting a rate material is removed from the component.

16 Claims, 3 Drawing Sheets

(56) References Cited

U.S. PATENT DOCUMENTS

2001/0007811 A1* 7/2001 Kawasaki ..... B24B 31/003 451/104
2002/0077047 A1* 6/2002 Kawasaki ..... B24B 1/00 451/326
2002/0173238 A1* 11/2002 Kordonski ..... B24B 13/0025 451/36
2003/0216110 A1* 11/2003 Bohm ..... B24B 31/003 451/36
2007/0138023 A1* 6/2007 Lee ..... B23H 3/00 205/652
2010/0233510 A1* 9/2010 Sroka ..... B24B 5/00 428/687
2010/0304644 A1* 12/2010 Gogolewski ..... B24B 7/22 451/36
2012/0136452 A1* 5/2012 Richter ..... A61F 2/3868 623/20.28
2013/0225049 A1 8/2013 Shorey et al.
2016/0082565 A1* 3/2016 Kenda ..... B24B 31/006 451/36

* cited by examiner

METHOD AND SYSTEM FOR FINISHING COMPONENT USING ABRASIVE MEDIA

BACKGROUND

Manufactured items, such as components for gas turbine engines, often require surface finishing to achieve certain mechanical properties. Components formed using additive manufacturing, brazing, or welding, as examples, may require surface cleaning (to remove burrs or partially fused particles) before the components can be used in an engine. Components formed using other techniques may also benefit from surface finishing.

One known surface finishing technique is known as micromachining. A micromachining process involves the use of an abrasive fluid, which includes a carrier fluid carrying an abrasive media. In this known process, a vessel contains a component to be finished, and the vessel is filled with a first abrasive fluid. The first abrasive fluid is used to finish the component. Following a first surface finishing process, the vessel is drained and a second abrasive fluid fills the vessel. The second abrasive fluid is then used to further finish the component. The process may repeat itself using additional abrasive fluids. Between each step, the vessel is completely drained and refilled with a new abrasive fluid.

Another existing surface finishing technique is known as tumbling. In a tumbling process, a component is held in an open-air container, and a plurality of abrasive particles are run over the component. Other known surface finishing techniques use magnetic fields, such as magnetic abrasive finishing, magnetic flow polishing, or magnetorheological finishing techniques. These magnetic techniques typically use open-air containers.

SUMMARY

A method according to an exemplary aspect of the present disclosure includes, among other things, at least partially filling a vessel with an abrasive fluid, pressurizing the abrasive fluid, and vibrating a component within the vessel. The method further includes gradually adjusting a rate material is removed from the component.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

BRIEF DESCRIPTION OF THE DRAWINGS

The drawings can be briefly described as follows.

DETAILED DESCRIPTION

Figure 1:
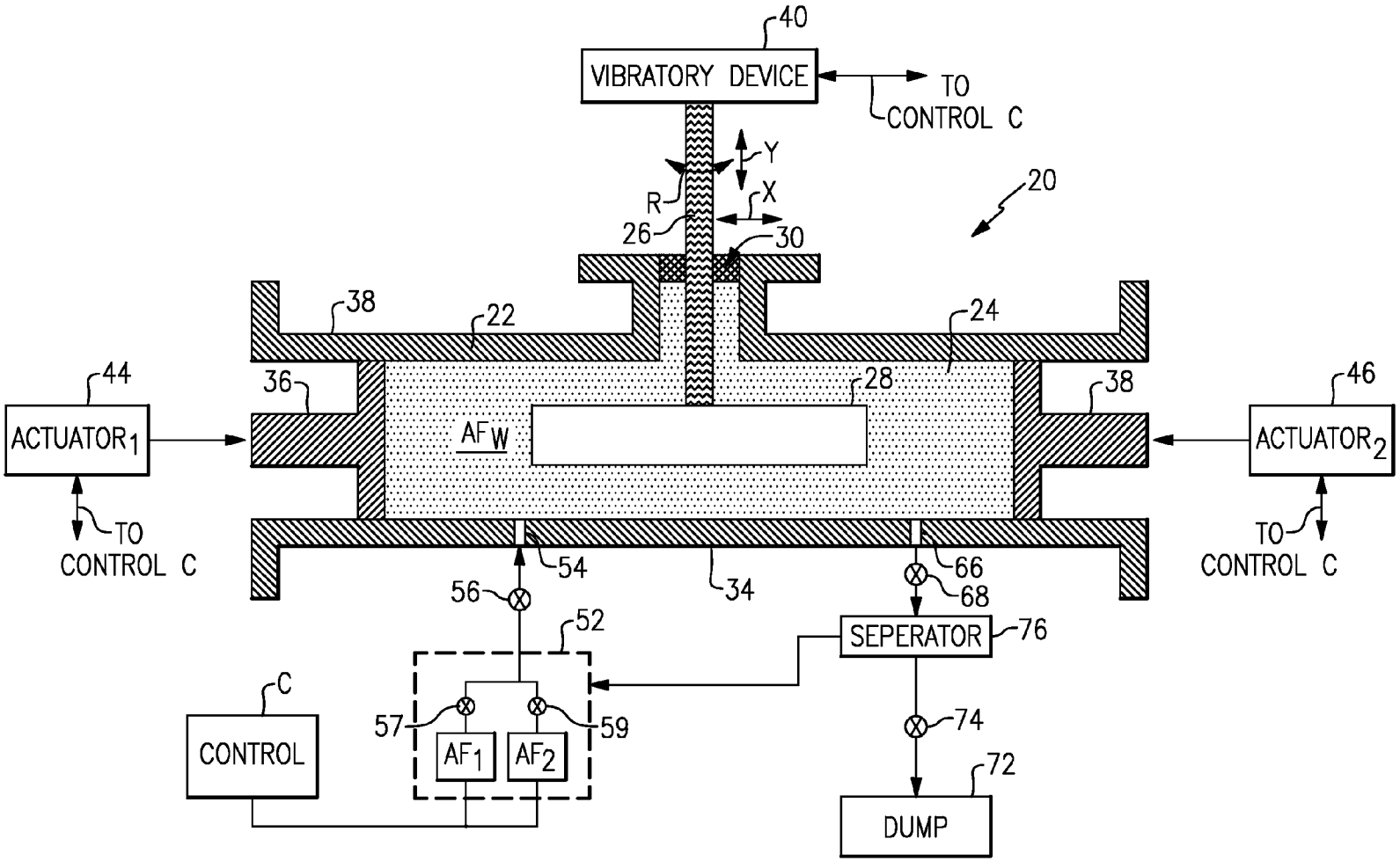
FIG. 1 schematically illustrates a first example surface finishing system.

FIG. 1 illustrates a system 20 for finishing a component, or substrate, using an abrasive fluid. In this example, the system 20 includes a vessel 22, which is enclosed and provides an interior chamber 24. As will be discussed in detail below, a component is provided in the interior chamber 24, and the interior chamber 24 is at least partially filled with an abrasive fluid. The abrasive fluid works the exterior surface of the component, and provides a desired surface finish.

In one example, a mounting rod 26 supports a component 28 within the interior chamber 24. The mounting rod 26 is sealed relative to the vessel 22 by a seal 30. A mounting rod 26 is not required in all examples, as is shown relative to FIG. 2 (discussed below).

The vessel 22 includes upper and lower walls 32, 34. In this example, a first piston 36 and a second piston 38 are provided on opposite ends of the vessel 22 between the upper and lower walls 32, 34. While not illustrated, the pistons 36, 38 include seals (such as O-rings) abutting the upper and lower walls 32, 34. Together, the seal 30, the upper and lower walls 32, 34, and the first and second pistons 36, 38 enclose the interior chamber 24.

In this example, the mounting rod 26 is connected to a vibratory device 40 (sometimes spelled "vibritory" device), which may include one or more motors. The vibratory device 40 is operable in response to instructions from a control C, and is configured to vibrate the mounting rod 26. Ultimately, the vibratory device 40 is configured to vibrate the component 28 within the interior chamber 24. The vibratory device 40 may be configured to oscillate the mounting rod 26 (and, in turn, the component 28) up-and-down (in the Y-direction), side-to-side (in the X-direction), and rotationally (in the R-direction) and any combinations thereof.

The control C may be any known type of controller including memory, hardware, and software. The control C is configured to store instructions, and to provide instructions to the various components of the system 20. The control C may include one or more components.

As noted above, the mounting rod 26 is not required in all examples. An alternate arrangement is shown in FIG. 2, which illustrates a system 120 corresponding to the system 20 of FIG. 1, with like parts having reference numerals preappended with a "1." In FIG. 2, the component 128 is supported within the interior chamber 124 of the vessel 122 by a pedestal 142 extending upwardly from the lower wall 134 of the vessel 122.

Figure 2:
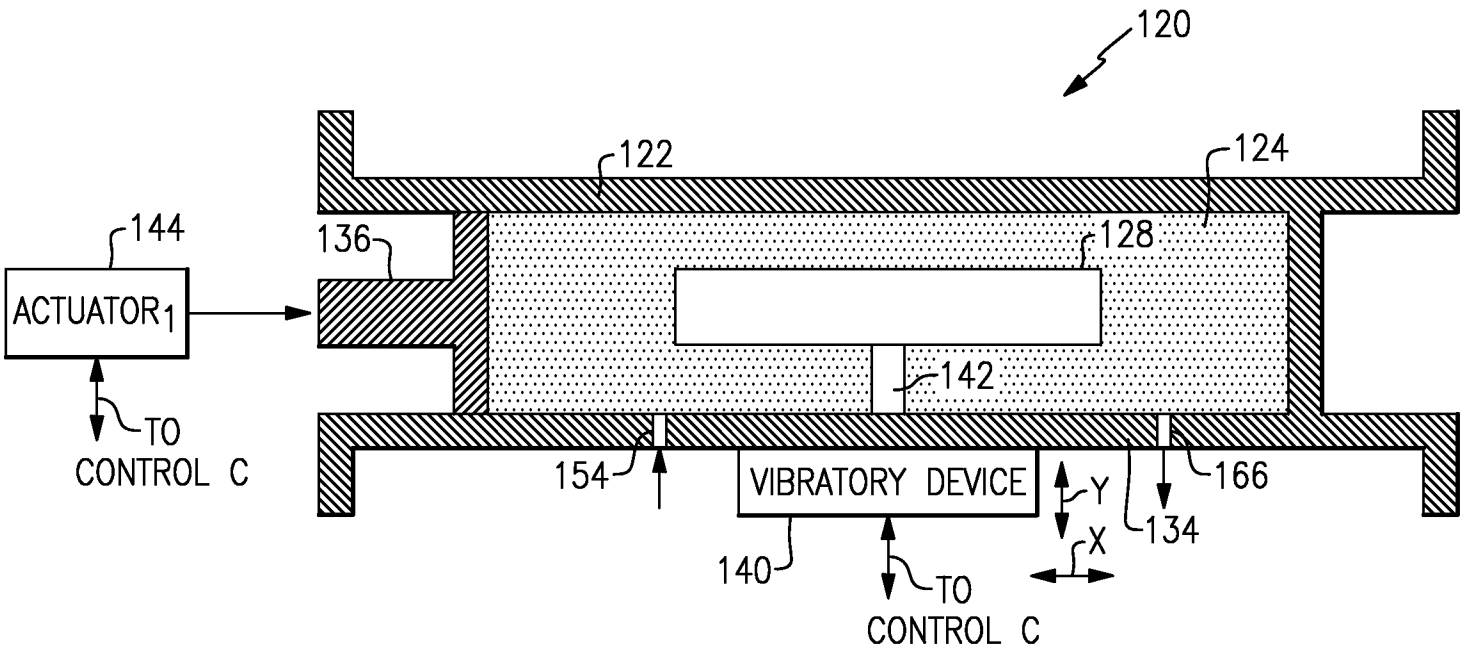
FIG. 2 schematically illustrates a second example surface finishing system.

In the example of FIG. 2, a vibratory device 140 is connected to the vessel 122. In particular, the vibratory device 140 is connected directly to the lower wall 134 of the vessel 122, although it could be connected to the vessel 122 at another location. The vibratory device 140, like the vibratory device 40, may include one or more motors. The vibratory device 140 is configured to vibrate the vessel 122 which, in turn, vibrates the platform 142 and results in movement of the component 128 within the interior chamber 124.

Turning back to FIG. 1, the first and second pistons 36, 38 are each in communication with first and second actuators 44, 46. The first and second actuators 44, 46 are responsive to instructions from the control C to adjust the position of the pistons 36, 38. The relative position of the pistons 36, 38 dictates the size (i.e., volume) of the interior chamber 24, and changes a pressure of a fluid within the interior chamber 24. In this example, the pistons 36, 38 are moveable in the side-to-side direction (the X-direction) by way of the actuators 44, 46.

While two pistons 36, 38 and two corresponding actuators 44, 46 are illustrated in FIG. 1, it should be understood that this disclosure extends to examples having one or more pistons. For instance, in some examples there may only be a single piston. As shown in the system 120 of FIG. 2, there is a single piston 136 that is moveable by a corresponding first actuator 144. Like the first and second pistons 36, 38, the single piston 136 is moveable via the actuator 144 in response to corresponding instructions from the control C. Additionally, while pistons are specifically contemplated in this disclosure, the pressure of the vessel 22 could be adjusted in another known way.

Figure 3:
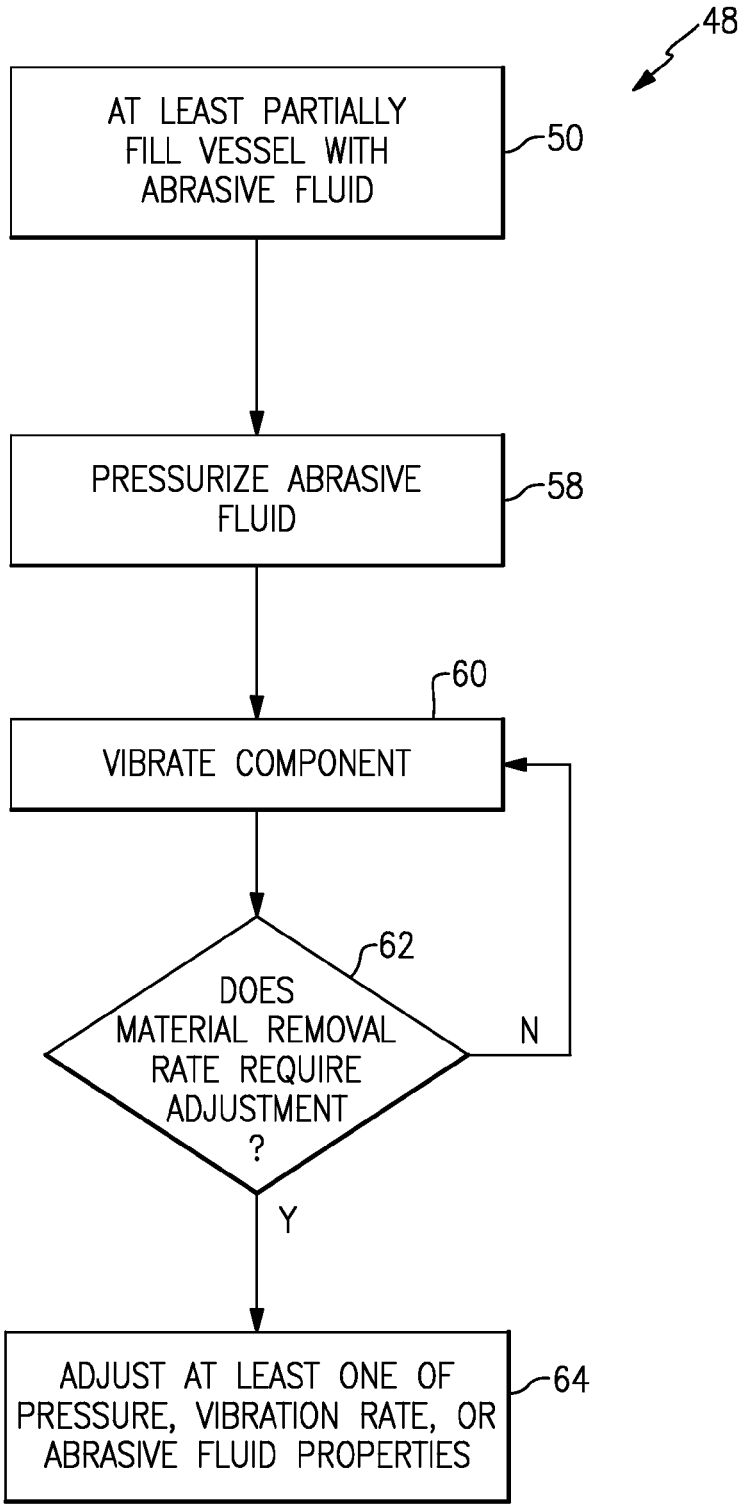
FIG. 3 is a flowchart representing an example method according to this disclosure.

FIG. 3 illustrates an example method 48 for finishing a surface of a component. As shown in FIG. 3, at 50, the interior chamber 24 of the vessel 22 is at least partially filled with an abrasive fluid $AF_W$ configured to work the surface of the component 28. In another example, the interior chamber 24 is completely filled.

With joint reference to FIGS. 1 and 3, in order to fill the interior chamber 24, the control C is in communication with an abrasive fluid source 52. The abrasive fluid source 52 includes at least two sources of abrasive fluids $AF_1$, $AF_2$. The abrasive fluids $AF_1$, $AF_2$ have different properties. The properties may be different because the abrasive fluids have different carrier fluids, different abrasive media of different sizes, or both. Example abrasive fluids may include carrier fluids provided by acids, such as citric or nitric acid, and may further include an abrasive media provided by cubic boron nitride (CBN) particles or aluminum oxide ($Al_2O_3$) particles, as examples.

In one example, the first abrasive fluid $AF_1$ provides a lower material removal rate than the second abrasive fluid $AF_2$. This may be because the first abrasive fluid $AF_1$ has a less acidic carrier fluid and/or because the size of the abrasive media (i.e., size of the particles) within the first abrasive fluid $AF_1$ may be smaller than the size of the abrasive media in the second abrasive fluid $AF_2$.

The abrasive fluid source 52 may include one or more pumps (not pictured), a plurality of valves (e.g., valves 57, 59), and is fluidly coupled to an inlet port 54 to the interior chamber 24 by way of an inlet valve 56. The control C is electrically coupled to the abrasive fluid source 52 (including the individual components). In particular, the control C is operable to selectively adjust valves 57, 59 associated with sources of the first and second abrasive fluid $AF_1$ and the second abrasive fluid $AF_2$, respectively. The control C is further electrically coupled to the inlet valve 56. The control C is operable to provide instructions to these components to establish a flow of fluid from the abrasive fluid source 52 to the inlet port 54 and into the interior chamber 24.

The abrasive fluid $AF_W$ within the interior chamber 24 includes a carrier fluid carrying an abrasive media. In one example, the abrasive media includes a plurality of particles. In this example, again, the source of abrasive fluid 52 includes at least two different abrasive fluids, $AF_1$ and $AF_2$ having different material removal rates (because of the different carrier fluids, abrasive media sizes, or both). Depending on the material of the component 28, which could be steel, ceramic, or some other material, and depending on the desired end finish of the component 28, the control C is operable to provide an abrasive fluid of a particular material removal rate into the interior chamber 24. This will be discussed in more detail below.

After the vessel 22 is at least partially filled with abrasive fluid $AF_W$, the abrasive fluid $AF_W$ is pressurized, at 58, by adjusting the relative positions of the first and second pistons 36, 38, for example. Pressurizing the abrasive fluid $AF_W$ increases the coverage, by surface area, between the abrasive fluid $AF_W$ and the exterior surface of the component 28.

Next, at 60, the component 28 is vibrated within the interior chamber 24 by the vibratory device 40. Again, as discussed above, the component 28 may be vibrated in one or more directions. As the component is vibrated, at 60, the abrasive fluid $AF_W$, which is under pressure, works the exterior surface of the component 28. In particular, the abrasive fluid $AF_W$ removes burrs, polishes the exterior surface, and/or remove excess material.

This is disclosure may be particularly useful when the component 28 has been formed using an additive manufacturing process, as many unfused particles may remain on the exterior of the surface. Likewise, if the component has been welded or brazed, the exterior of the component may require smoothing and polishing. Components formed using other techniques can also benefit from this disclosure.

During finishing, the rate at which material is removed from the component 28 (i.e., the material removal rate) may require an adjustment. At 62, if the material removal rate does require an adjustment, a change is made, at 64, relative to at least one of (1) the pressure of the abrasive fluid $AF_W$, (2) the vibration rate of the component 28, and (3) the properties of the abrasive fluid $AF_W$ within the interior chamber 24. It should be understood that each of these adjustments may be made at the same time. It should also be understood that one or more of these adjustments can be made without interrupting the finishing process.

In order to increase material removal rate, the amplitude of the oscillations of the vibratory device 40 may be increased. Likewise, to reduce material removal rate, the amplitude of the oscillations may be decreased. Similarly, increasing the pressure of the abrasive fluid $AF_W$ by adjusting the relative position of the pistons 36, 38, for example, will increase the material removal rate. Likewise, decreasing pressure of the abrasive fluid $AF_W$ will reduce material removal rate.

Additionally, changing the properties of the abrasive fluid $AF_W$ within the interior chamber 24 will affect material removal rate. This change in properties may be brought about by changes to the carrier fluid or the abrasive media within the interior chamber 24. In one example, the interior chamber 24 of the vessel 22 is initially filled with the first abrasive fluid $AF_1$. In this example, the first abrasive fluid $AF_1$ includes abrasive media particles having a smaller size (e.g., diameter) than the second abrasive fluid $AF_2$.

Continuing with this example, if an increase in material removal rate is required, the control C would provide instructions to the system 20 to establish a flow of the second abrasive fluid $AF_2$ into the interior chamber 24. The instruction would include, for example, instructions to open valves 56 and 57. The larger particles of the second abrasive fluid $AF_2$ would intermix with those of the first abrasive fluid $AF_1$ already within the interior chamber 24. As the second abrasive fluid $AF_2$ is added into the interior chamber 24, the average particle size within the interior chamber 24 gradually increases, which leads to an increased material removal rate. As the second abrasive fluid $AF_2$ flows into the interior chamber 24, a corresponding amount of the intermixed abrasive fluid $AF_W$ is expelled from the interior chamber 24 by an outlet port 66, which is regulated by an outlet valve 68, until a desired average particle size within the interior chamber 24 is reached.

To reduce the material removal rate after having added the second abrasive fluid $AF_2$, the control C could provide an instruction to the system 20 to establish a flow of the first abrasive fluid $AF_1$ into the interior chamber 24. The relatively small particles associated with the first abrasive fluid $AF_1$ would gradually reduce the average particle size within the interior chamber 24, and reduce the material removal rate.

With reference to FIG. 1, as the abrasive fluid $AF_W$ works the exterior surface of the component 28, it will begin to collect material from the component 28. In one example, the abrasive fluid $AF_W$ flows from the outlet port 66, downstream of the outlet valve 68, and to a separator 70. The separator 70 may include a sifter or a magnetic separator. The separator 70 may separate the material of the component 28, such as metal, from the abrasive fluid $AF_W$, and return the abrasive fluid $AF_W$ to the abrasive fluid source 52 for further use. Alternatively, the separator 70 can be bypassed and the fluid can be sent to a dump 72 by selective operation of a dump valve 74.

This disclosure provides a material removal rate that is adjustable gradually. Again, the material removal rate can be adjusted without interrupting the finishing process. Further, this disclosure can be used to perform finishing operations that require different material removal rates for different time periods (again, without process interruption). For example, the control C can instruct the system 20 to perform a machining operation using a first abrasive fluid (which provides a first material removal rate) for a first time period, gradually adjust to a second material removal rate by intermixing a second abrasive fluid with the first, and then perform a machining operation for a second time period, and so on. While FIG. 1 illustrates two abrasive fluids $AF_1$, $AF_2$, there may be additional sources of abrasive fluid. These additional sources may include carrier fluids having different strengths and/or abrasive media having different sizes.

Changes to the abrasive fluid $AF_W$ within the interior chamber 24 can be made concurrent with changes to the vibratory device 40 and the position of the pistons 36, 38. Since these adjustments can be made without interrupting the finishing process, the component 28 can be finished in an expedited manner.

Although the different examples have the specific components shown in the illustrations, embodiments of this disclosure are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

What is claimed is:

1. A method, comprising:

at least partially filling a vessel with an abrasive fluid;

pressurizing the abrasive fluid by adjusting a position of at least one piston relative to the vessel;

vibrating a component within the vessel; and gradually adjusting a rate material is removed from the component.

2. The method as recited in claim 1, wherein the material removal rate is adjusted by changing the pressure of the abrasive fluid.

3. The method as recited in claim 1, wherein the material removal rate is adjusted by changing the rate at which the component is vibrated.

4. The method as recited in claim 1, wherein the material removal rate is adjusted by adjusting the properties of the abrasive fluid within the vessel.

5. The method as recited in claim 4, wherein a carrier fluid within the vessel is changed.

6. The method as recited in claim 4, wherein a size of abrasive media within the vessel is changed.

7. The method as recited in claim 6, wherein the size of abrasive media within the vessel is changed by establishing a flow of a first abrasive fluid into the vessel, the first abrasive fluid having an abrasive media size different than a second abrasive fluid already within the vessel.

8. The method as recited in claim 7, wherein the first abrasive fluid flows into the vessel and mixes with the second abrasive fluid until the desired average abrasive media size is reached.

9. The method as recited in claim 1, wherein the vessel is an enclosed vessel.

10. A system, comprising:

a vessel containing an abrasive fluid and a component;

a vibratory device configured to cause movement of the component within the vessel;

at least one piston configured to pressurize the abrasive fluid within the vessel; and a control configured to provide instructions to the piston and the vibratory device such that the component is vibrated within the vessel while the abrasive fluid is pressurized, the control further configured to provide instructions to the system to gradually adjust a rate material is removed from the component.

11. The system as recited in claim 10, wherein the control is configured to adjust the material removal rate by providing an instruction to the at least one piston to change the pressure of the abrasive fluid.

12. The system as recited in claim 10, wherein the control is configured to adjust the material removal rate by providing an instruction to the vibratory device to change the rate at which the component is vibrated.

13. The system as recited in claim 10, wherein the control is configured to adjust the material removal rate by providing an instruction to the system to change properties of the abrasive fluid within the vessel.

14. The system as recited in claim 13, wherein the change in properties includes one of a change in a carrier fluid and a change in abrasive media size.

15. The system as recited in claim 10, wherein the abrasive fluid includes a carrier fluid provided by one of (1) nitric acid and (2) citric acid, and wherein the abrasive fluid includes an abrasive media provided by one of (1) cubic boron nitride (CBN) and (2) aluminum oxide ($Al_2O_3$).

16. The system as recited in claim 10, wherein the vessel is an enclosed vessel.

* * * * *